US010953967B2

(12) United States Patent
Bergman

(10) Patent No.: US 10,953,967 B2
(45) Date of Patent: Mar. 23, 2021

(54) UNDERWATER ROV (REMOTELY OPERATED VEHICLE) WITH A DISRUPTOR FOR ELIMINATING UNDERWATER EXPLOSIVES

(71) Applicant: Deep Ocean Engineering, San Jose, CA (US)

(72) Inventor: John D. Bergman, Springfield, OR (US)

(73) Assignee: DEEP OCEAN ENGINEERING, San Jose, CA (US)

( * ) Notice: Subject to any disclaimer, the term of this patent is extended or adjusted under 35 U.S.C. 154(b) by 0 days.

(21) Appl. No.: 15/945,701

(22) Filed: Apr. 4, 2018

(65) Prior Publication Data

US 2018/0281911 A1 Oct. 4, 2018

Related U.S. Application Data

(60) Provisional application No. 62/481,233, filed on Apr. 4, 2017.

(51) Int. Cl.

| | |
|---|---|
| ***B63G 8/08*** | (2006.01) |
| ***B63G 8/00*** | (2006.01) |
| ***F42B 33/06*** | (2006.01) |
| ***B63G 7/00*** | (2006.01) |

(52) U.S. Cl.

CPC ..... *B63G 8/001* (2013.01); *B63G 7/00* (2013.01); *B63G 8/08* (2013.01); *F42B 33/062* (2013.01); *B63G 2007/005* (2013.01); *B63G 2008/007* (2013.01)

(58) Field of Classification Search

CPC ..... B63G 8/001; B63G 2008/001; B63G 2008/005; B63G 2008/007; B63G 8/08; B63G 2008/08; F42B 33/062

USPC ..... 114/312, 313, 316, 318, 319, 322, 337

See application file for complete search history.

(56) References Cited

U.S. PATENT DOCUMENTS

| | | | | |
|---|---|---|---|---|
| 5,433,646 | A * | 7/1995 | Tarng | F41B 9/0018 222/78 |
| 10,167,066 | B2 * | 1/2019 | Robertson | F41H 11/16 |
| 2009/0090286 | A1 * | 4/2009 | Korolenko | B63G 8/30 114/5 |

* cited by examiner

*Primary Examiner* — Daniel V Venne

(74) *Attorney, Agent, or Firm* — Law Office of Dorian Cartwright; Dorian Cartwright

(57) ABSTRACT

An underwater disruptor comprises a water tight chamber formed by a modified housing, a modified breech, and a modified backplate sealed together by a plurality of O-rings. The underwater disruptor is configured to discharge a firing pin to shoot a water bullet from the modified barrel at a specific underwater explosive threat responsive to receiving a fire command from a remote operator. The water bullet is formed from water ejected from the barrel due to the discharge. The underwater ROV physically hosts the underwater disruptor and is configured to provide video feedback during underwater travel remotely to the specific underwater explosive and to activate shooting of the water bullet responsive to the fire command.

9 Claims, 10 Drawing Sheets

UNDERWATER ROV (REMOTELY OPERATED VEHICLE) WITH A DISRUPTOR FOR ELIMINATING UNDERWATER EXPLOSIVES

CROSS-REFERENCE TO RELATED APPLICATIONS

The current application claims priority under 35 USC 119(e) to U.S. Application No. 62/481,233, filed Apr. 4, 2017 by John D. Bergman, and entitled Underwater ROV (Remotely Operated Vehicle) with A Disruptor for Eliminating Underwater Explosives, the contents of which are hereby incorporated in its entirety.

FIELD OF THE INVENTION

The invention relates generally, to an underwater ROV, and more specifically, to an underwater ROV with an underwater disruptor for eliminating underwater explosives with water bullets.

BACKGROUND

Underwater security operations performed by the military, FBI, Coast Guard, or other security personnel sometimes encounter or suspect underwater explosives. For example, a harbor that was part of a military battle can be swept to clear the way for incoming ships or a suspected Improvised Explosive Device (IED) in the form of a backpack attached to an underwater section of a pier piling can be neutralized. Because water is an incompressible fluid, the transmission of explosions can be particularly devastating. Moreover, it is extremely hazardous for scuba divers to attempt such security operations in underwater environments.

Conventional terrestrial disruptors are used to disarm or otherwise neutralize IEDs on land. In more detail, an Explosive Ordinance Disposal (EOD) technician approaches the IED and shoots a laser-aimed water bullet that is projected from up to 10 meters away. However, conventional disruptors are limited to use on land because initiating the gunpowder-based explosive has significant technical challenges when performed underwater.

Shock tubes used for detonation, though simple when used on land, have limitations in an underwater environment. They are very sensitive to water. Even when used exclusively on land, they are susceptible to humidity. Great care must be taken to keep them very dry or they will not perform. Using them in an underwater application greatly reduces their reliability. Additionally, due to the ambient pressure of the deeper underwater environment, increasing one atmosphere every 33 feet, the percussive force of the shock tube is reduced and will not perform below a particular depth.

What is needed is a robust underwater ROV with a disruptor for safely neutralizing underwater IEDs or other explosive devices without detonation, or without substantial detonation.

SUMMARY

The above-mentioned shortcomings are addressed with an underwater ROV system for eliminating underwater explosives with water bullets, and methods and transitory computer-readable medium operating therein.

In one embodiment, an underwater disruptor comprises a water tight chamber formed by a modified housing, a modified breech, and a modified backplate sealed together and protected from water intrusion by a plurality of O-rings. The underwater disruptor is configured to electrically actuate a firing pin in response to receiving a fire command from a remote operator, initiating a gunpowder charge to shoot, or propel, a water bullet from the barrel which has been aimed at a specific underwater IED or other threat. The water bullet is formed from water ejected from the barrel due to the explosive discharge.

In another embodiment, an underwater ROV physically hosts the underwater disruptor. The underwater ROV is configured to provide video and location feedback during underwater travel remotely to the specific underwater explosive and to activate shooting of the water bullet responsive to the fire command. A cable spans from the underwater ROV to an onboard controller for providing data communications from the remote operator and for providing electrical power. In some embodiments, the underwater disruptor attaches to the underwater ROV with a multi-use connection that can also be used by a different peripheral hosted by the underwater ROV. Additional components can be hosted to operate in cooperation with the underwater disruptor operation, such as cameras, GPS devices, gyroscope devices, Inertial Navigation System (INS), Doppler Velocity Log (DVL), Multibeam Sonar, acoustic tracking, aim-assisting lasers, and the like.

Advantageously, underwater bullets can be remotely discharged to eliminate underwater explosive threats more safely.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

The present disclosure describes methods, computer program products, and systems for underwater ROV with an underwater disruptor for eliminating underwater IEDs or other explosives with water bullets.

The embodiments described herein are not limited to a single invention. One of ordinary skill in the art will recognize, given the disclosure herein, many possible variations within the scope of the present inventions, although not described in detail for conciseness.

Figure 3:
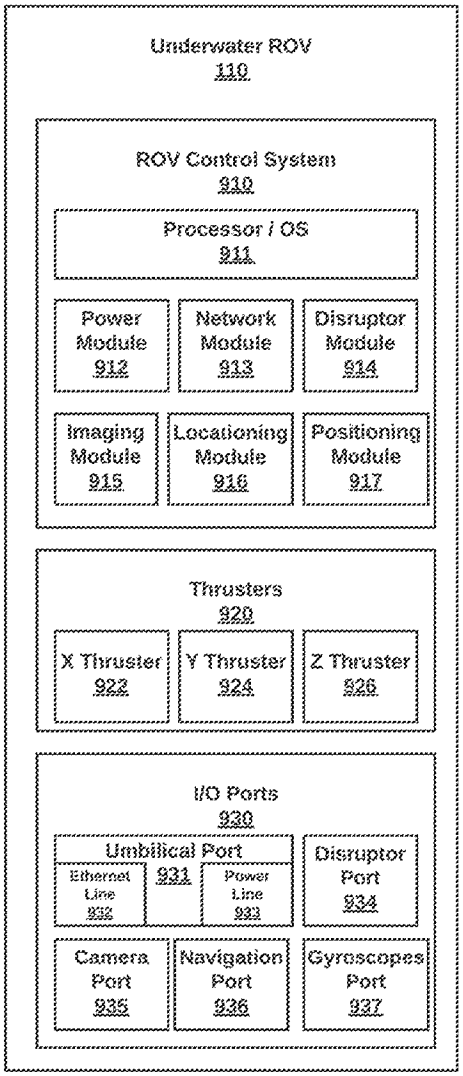
FIG. 3 is a more detailed block diagram illustrating the underwater ROV of FIG. 1, according to an embodiment.

I. Underwater ROV Disruptor Systems (FIGS. 1-3)

Figure 1:
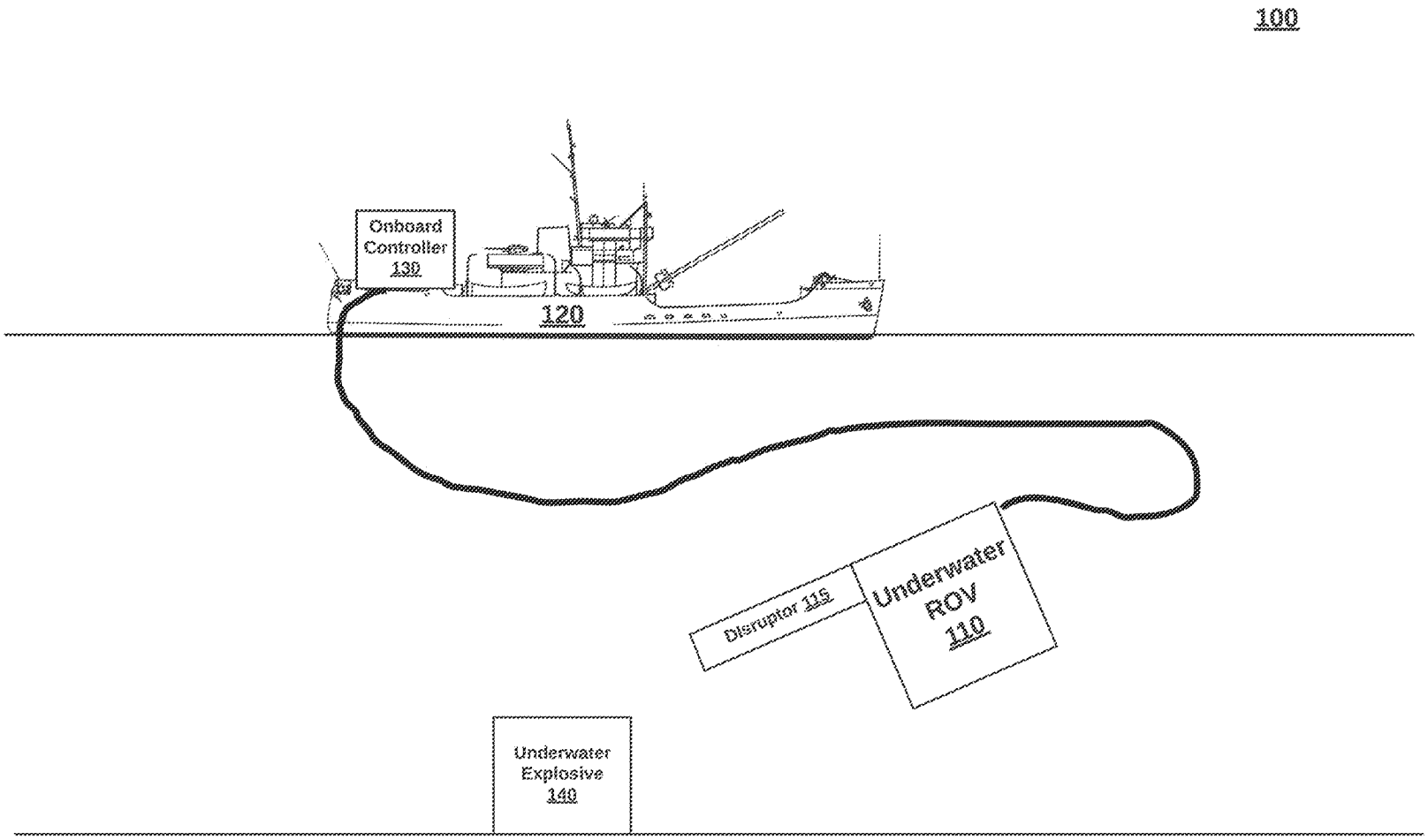
FIG. 1 is a high-level block diagram illustrating a system for an underwater ROV with a disruptor for eliminating underwater explosives, according to an embodiment.
Figure 2A:
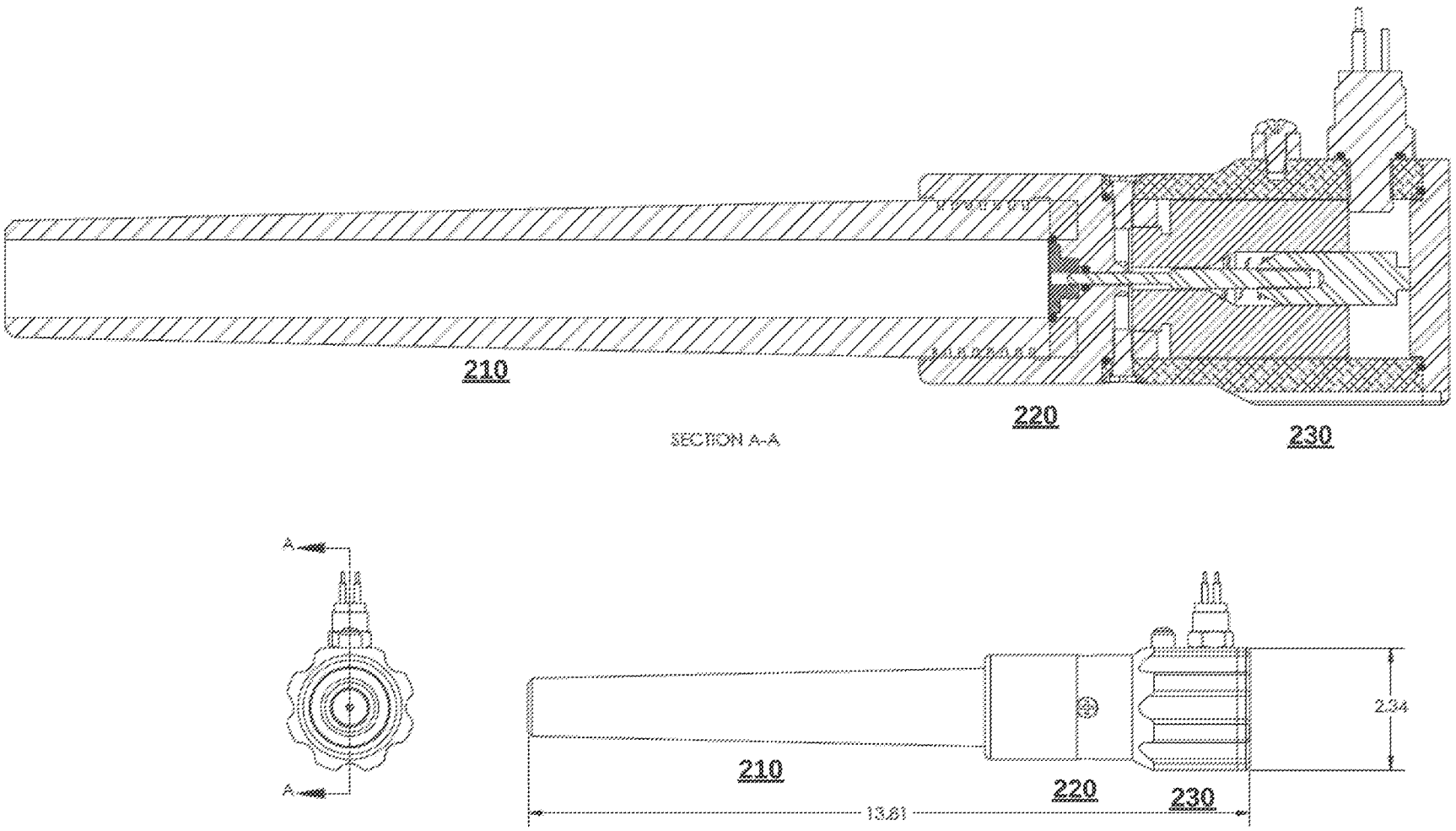
FIG. 2A is a schematic diagram showing different views if the disruptor of FIG. 1, according to some embodiments.
Figure 2B:
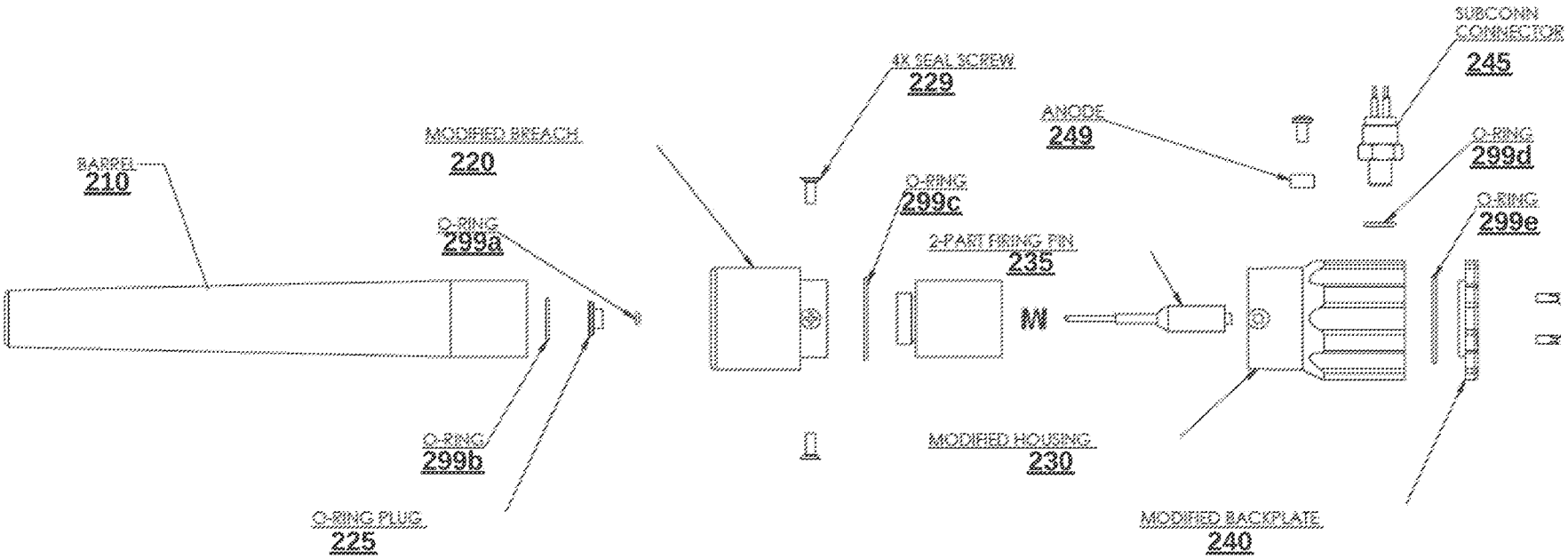
FIG. 2B is a schematic diagram showing an exploded view of the disruptor of FIG. 1, according to some embodiments.
Figure 2C:
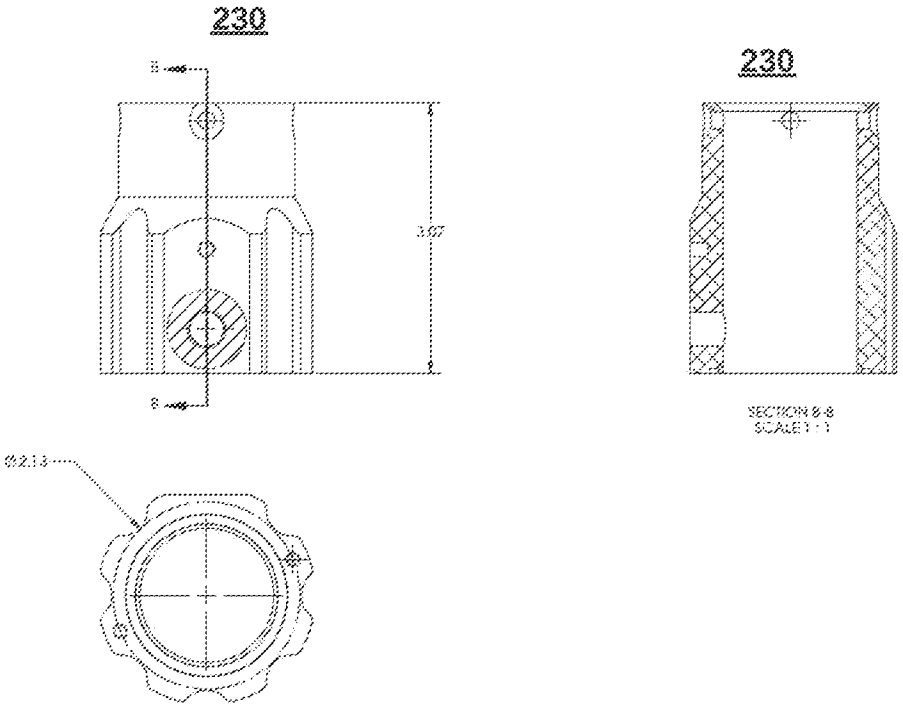
FIG. 2C is a schematic diagram showing different views of the housing for the disruptor of FIG. 2A, according to some embodiments.
Figure 2D:
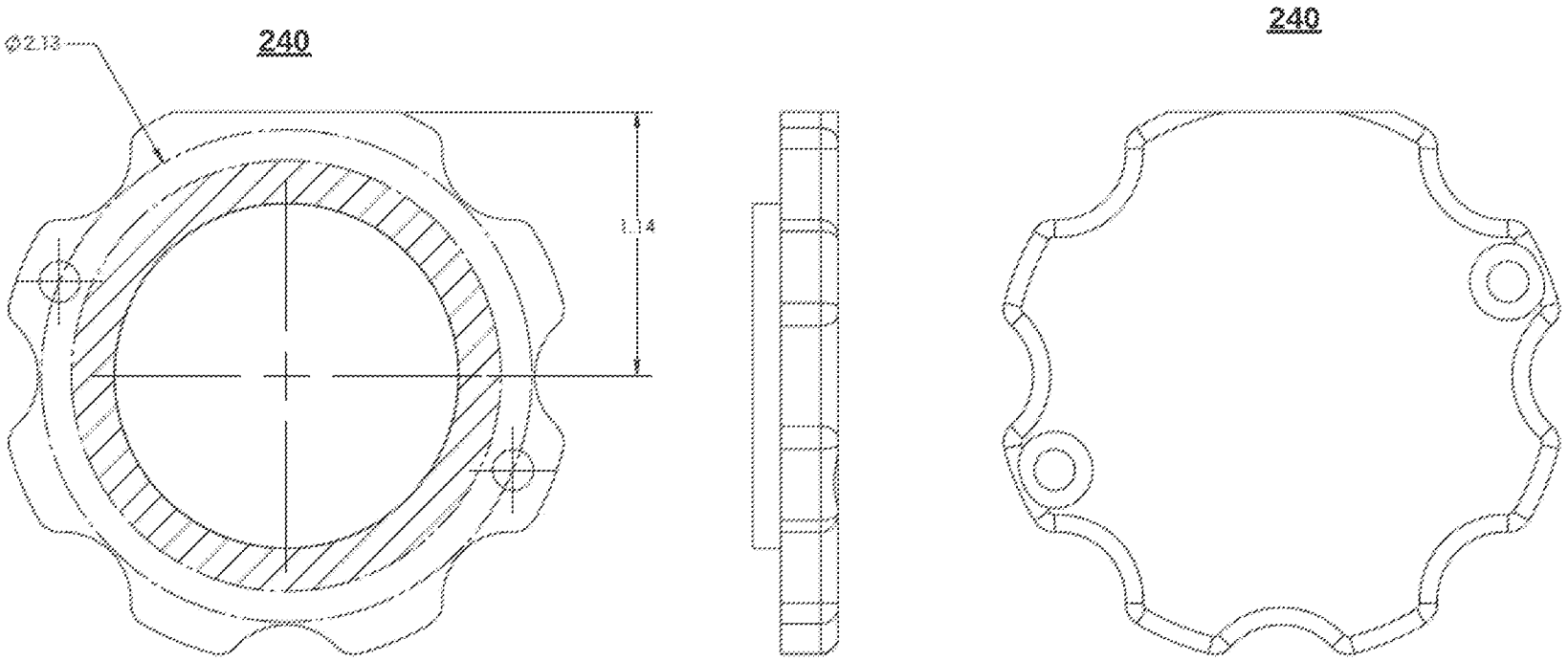
FIG. 2D is a schematic diagram showing different views of a back plate for the disruptor of FIG. 2A, according to some embodiments.
Figure 2F:
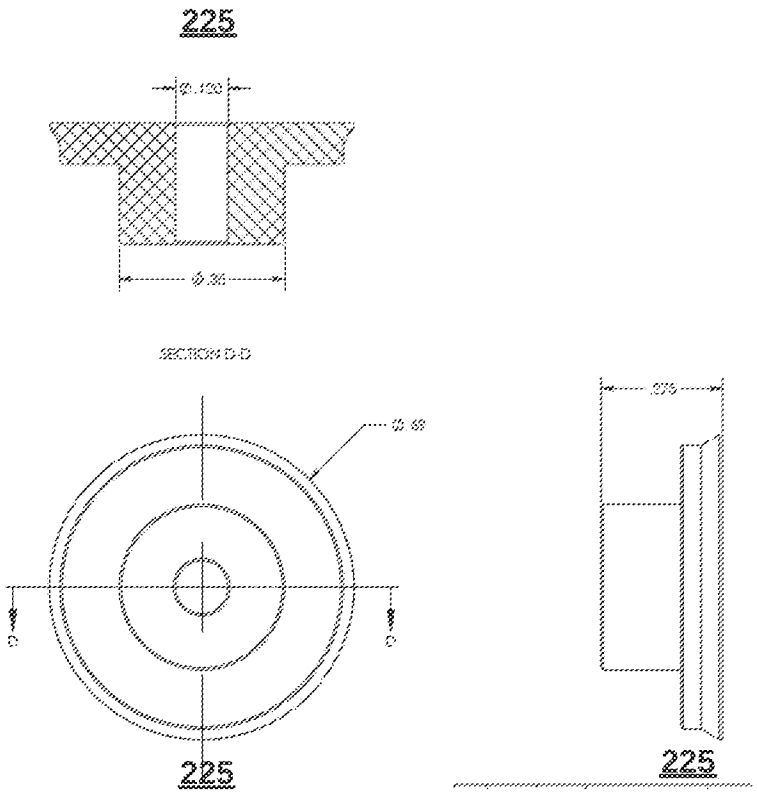
FIG. 2F is a schematic diagram showing different views of an O-ring plug for the disruptor of FIG. 2A, according to some embodiments.
Figure 2E:
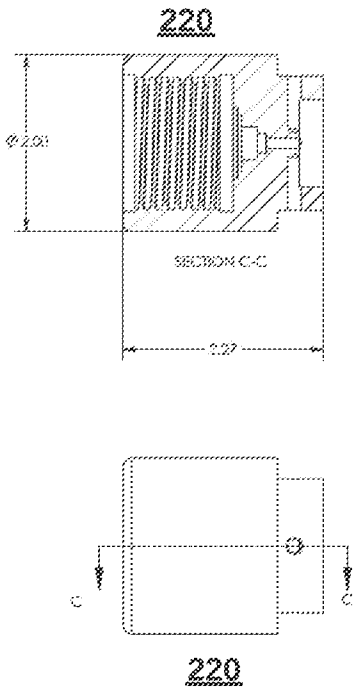
FIG. 2E is a schematic diagram showing different views of a breech adaptor for the disruptor of FIG. 2A, according to some embodiments.
Figure 2G:
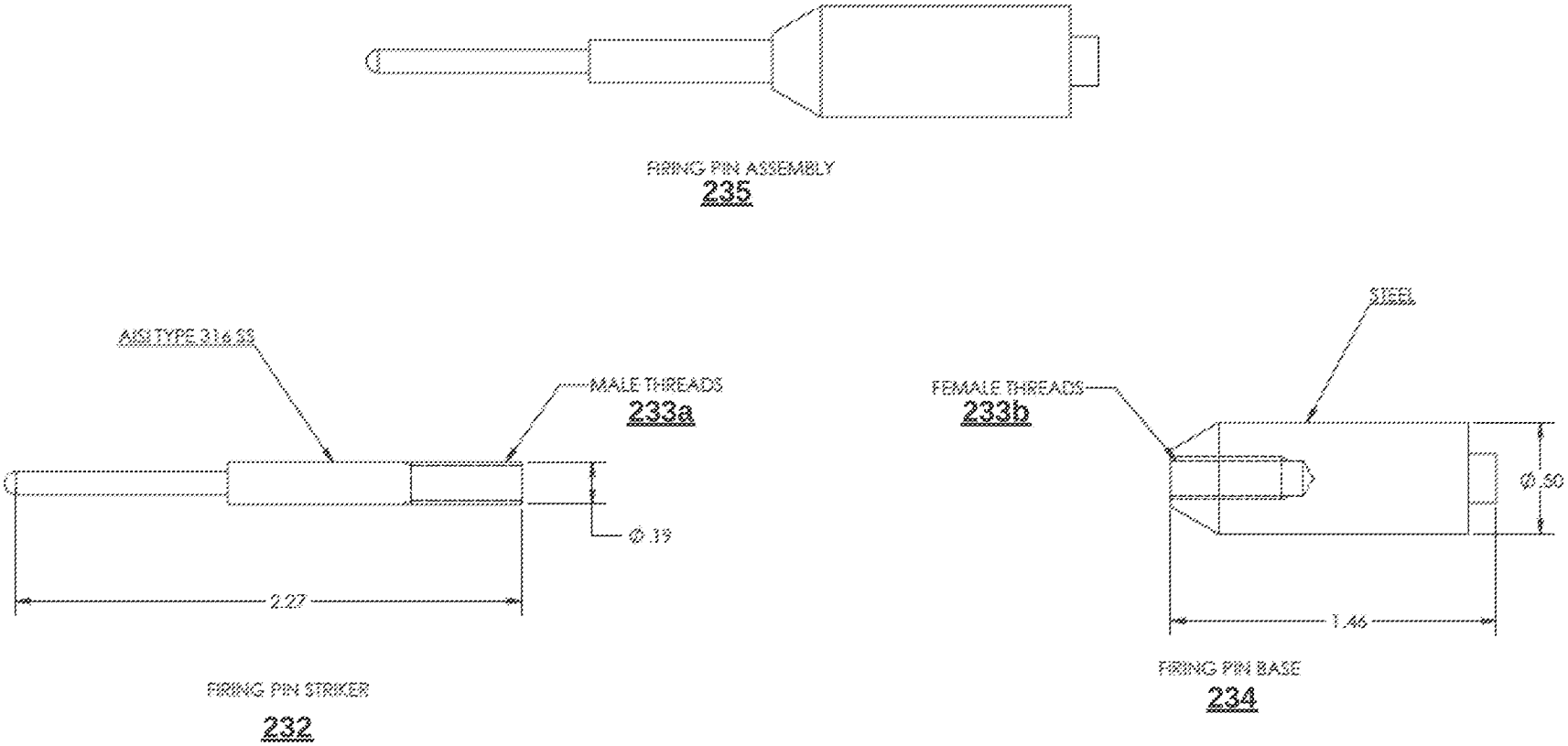
FIG. 2G is a schematic diagram showing different views of a firing pin for the disruptor of FIG. 2A, according to some embodiments.
Figure 2H:
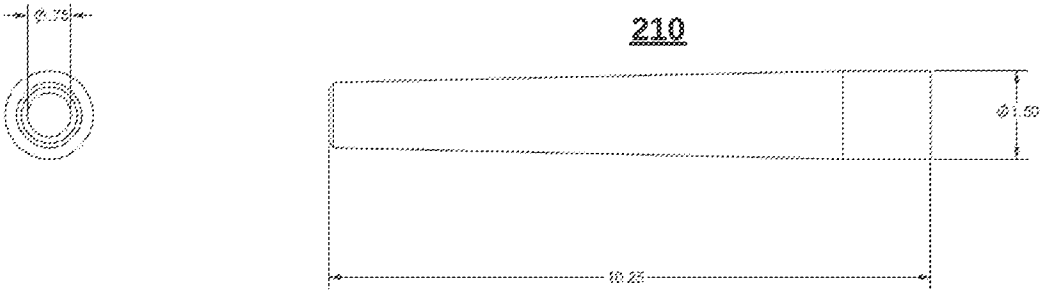
FIG. 2H is a schematic diagram showing different views of a barrel for the disruptor of FIG. 2A, according to some embodiments.

FIG. 1 is a high-level perspective diagram illustrating a system 100 for an underwater ROV equipped with a disruptor for eliminating underwater IEDs or other explosives, according to an embodiment. The system 100 comprises an underwater ROV 110 with a disruptor 115, a ship 120, an onboard controller 130, and an underwater explosive 140. Other embodiments of system 100 can include multiple ROVs, multiple controllers, multiple explosives, and alternative underwater terrains.

In one embodiment, the ROV 110 is deployed from the ship 120 in an area of water in which underwater explosives have been found or are suspected. An operator from the onboard controller 130 navigates the ROV 120 underwater to a location of the underwater explosive 140. Software analysis, in some embodiments, automatically recognizes objects warranting further investigation. Sonar sensors (e.g., a high-resolution imaging sonar) and low light auto focus camera provide identification feedback. When within range, a remote operator commands the disruptor 115 to fire a water bullet formed from a jet of water to destroy, or otherwise impair, the underwater explosive 140. Preferably, electronics of the underwater explosive 140 are disabled without detonation, or without significant detonation.

The underwater disrupter 115 includes a rigid frame for attaching various required components. There can also be space for attaching optional components. In an embodiment, the ROV 110 can be configured to remove the underwater disrupter 115 in different operations having different objectives. Likewise, the ROV 110 can be configured to attach a different peripheral on the connector of the rigid frame. A different embodiment is designed specifically for the single function of ameliorating underwater threats and can be further optimized with custom connectors.

To generate a water bullet, electrical energy can be stored to provide sufficient power to actuate a solenoid to forcefully extend a firing pin, for example, to initiate a 12-gauge blank bullet containing gun powder without any integrated metallic or other projectile material. Various implementations determine an optimal position and distance for shooting based on physics and fluid mechanics associated with the formation of a bullet with water, and the subsequent travel of the bullet through a water medium, potentially at tremendous hydrostatic pressure, to the target. Specific implementations of the underwater disruptor 115 are shown in FIGS. 2A-H, and specific implementations of the ROV 110 are shown in FIG. 10.

The onboard controller 130 can include a processor, a display, and individual controls for ROV functions. In operation, the operator observes video feedback or still pictures shown on the display for moving the ROV 110 coordinates up, down, left, right, and rotates the ROV 110 using a joystick or other digital mechanism. In response to identifying an object, one or more thrusters on the ROV 130 are activated at varied intensities to move into position. Even when commanded to hold a position (e.g., station keeping), the thrusters automatically activate to counteract water current that would otherwise move the ROV 130. Another control arms and fires the disruptor 115 once in position. In some cases, the ROV 110 is deployed to dislodge or disable other dangerous non-explosive objects.

Turning to FIGS. 2A-H, the disruptor 110 comprises generally a barrel 210, a breech 220 and a housing 230, all of which, except the barrel, are modified for the underwater environment. The modified housing 230 comprises a chamber for holding firing pin 235 against a modified backplate 240. The modified housing 230 is waterproof to keep the chamber water tight in order to protect the inside from water-induced electrical shorts and keep firing pin 235 free from movement hindrance due to water viscosity.

To remain water tight, on one side O-rings 299*a* and 299*b* seal the firing pin between the modified barrel 210 and the modified breech 220. Further, O-ring 299*c* seals between the modified breech 220 and the modified housing 230. O-ring 299*d* provides a seal for electrical bulkhead subconn connector 245 and O-ring 299*e* connects between the modified housing 230 and the modified backplate 240. Within the protected chamber, sits the firing pin 235 constructed in 2-parts, male threads 233*a* of a firing pin striker 232 mate to female thread 233*b* of a firing pin base 234. The firing pin striker 232 can be composed of stainless steel to prevent corrosion from water while the firing pin base 234 must be composed of a magnetic material in order to be actuated when the solenoid is energized. Sacrificial anode 249 serves to protect the disruptor assembly from potential corrosion. To fire, an electrical charge is received from electrical bulkhead subconn connector 245, actuating a solenoid, forcefully extending the firing pin assembly 235 for initiating a blank bullet loaded to the barrel 210 chamber.

Whether underwater or on land, the propellant explosive is initiated with a percussive force. Normal firearms use a firing pin and spring mechanism to apply the initiating percussive force when the firearm's trigger is pulled. When it is required to initiate the explosive remotely, as is the case in the underwater environment, at a distance from the trigger puller, the percussive force required to initiate the explosive can be applied via either an electric solenoid or shock tube. The shock tube is generally a small-diameter hollow plastic tubing that is filled with an explosive that can be initiated at one end, sending a percussive shock wave that propagates to the other end and delivers the percussive force to the firing pin.

Shock tubes used for detonation, though simple, have limitations in an underwater environment. They are very sensitive to water. Even when used exclusively on land, they are susceptible to humidity. Great care must be taken to keep them very dry or they will not perform. Using them in an underwater application greatly reduces their reliability. Additionally, due to the ambient pressure of the deeper underwater environment, increasing one atmosphere every 33 feet, the percussive force of the shock tube is reduced and will not perform below a particular depth.

An electric solenoid 234 sits between the modified breach 220 and the firing pin 235 and provides the percussive force requires a watertight housing for the mechanical components and the electronics for both energizing the solenoid coil and providing telemetry to the trigger puller located at a distance on the surface. The underwater disruptor 115 has proven to be effective at providing the percussive force to the firing pin while deep underwater and can remain underwater and retain its effectiveness for long periods of time.

Turning now to details of the ROV 110 as shown in the block diagram of FIG. 3. The underwater ROV 110 comprises an ROV control system 910, thrusters 920 and I/O ports 930. One of ordinary skill in the art would recognize many other configurations are possible, for example, with additional peripherals, sensors, batteries, and the like.

Generally, the ROV control system 910 is coupled to thrusters 920 for positioning the underwater ROV 110 movement and hoovering. Also, the ROV control system 910 is coupled to the I/O ports 930 for data and electrical power transfers necessary to provide visibility and navigation information to an operator and execute commands on behalf of the operator.

More specifically, the ROV control system 910 further comprises a processor/OS 911 coupled to execute a network module 912, a disruptor module 913, an imaging module 914, a locationing module 915 and a stability module 916. In one embodiment, a disruptor module 912 can receive commands from an Ethernet line 932 of umbilical port 931 to control the underwater disruptor 115 with data and power transferred through a disruptor port 933. For example, the data path and electrical path allow a remote operator to use a joystick to position the underwater ROV 110, using navigation, sonar, and video feedback. The remote operator fires a water bullet with the click of a button. The modules can be implemented in software, hardware, or a combination of both.

Processor/OS 911 provides hardware and software support for hosting various peripherals and accessories. The underwater disruptor 115 connects through the I/O ports and is supported by a downloaded disruptor module. Other hosted devices include navigation devices, cameras, GPS receivers, and gyroscopes. Many other possibilities exist.

One or more processors of processor/OS 911 can be a general processor, an ASIC, FPGA, or the like by manufacturers such as Intel, AMD, ARM, and others. In one embodiment, a processor is multi-core processor that dedicates a certain core for disruptor control. An operating system can be a set of custom instructions or an OEM operating system such as Windows, Linux, macOS or Android.

The power module 912 can control power received from power line 933 and distribute power to disruptor port 934, camera port 935, navigation port 936 and gyroscopes port 937. In one embodiment, a current is sent through the disruptor port 934 to charge the underwater disruptor 115 for firing a water bullet. In another embodiment, the power module 912 diverts current to a battery for charging the battery. Additional electronic circuitry for support can include transformers, op amps, and the like.

The network module 913 can control data received from Ethernet line 932 by parsing network packets and passing commands and information to appropriate modules. Network packets can also be transmitted through the Ethernet line 932, for instance, a video stream from an HD camera. Other supporting hardware can include a network processor that offloads certain tasks from the processor.

The imaging module 915 establishes a data path with cameras coupled to camera port 935 for receiving video streams and stills, preferably at a high resolution or HD quality. The imaging module 915 also couples to sensors for receiving sonar imaging data, at a relatively lower resolution.

The locationing module 916 tracks a real-time geolocation of the underwater ROV 110. Navigation port 936 can be coupled to a GPS device attached to the underwater ROV 110 and connected by a cord. Additionally, locationing module 916 can receive from navigation port 936 navigation information from an INS, DVL, and optionally acoustic tracking system and orientation input from multi-axis accelerometers and gyroscopes connected to gyroscopes port 937 and this can be reported in stream to a remote operator. Many other types of sensors (e.g., temperature sensor, electronic compass, or depth sensor) can be attached for data collection and analysis.

The positioning module 917 activates thrusters 920 to propel the underwater ROV for movement or hoovering in a static location. Input received from GPS port 936 and/or gyroscopes port 937, or other locationing sensor port can be processed by positioning module 917 to determine thrust action needed to move from real-time geolocation to a desired location. One implementation receives a desired location from an operator at the onboard controller 130, and automatically propels to the desired location. X thruster 921, y thruster 922 and z thruster 923 are substantially orthogonal to provide balanced propulsion. However, in alternative embodiments, thrusters can be rotated for biasing to accommodate a stronger descent or a stronger ascent based on conditions at the time of deployment. Using video feedback, an operator can guide the underwater ROV 110 to a preferred position for successful disablement of explosives. The thrusters counter current, gravity and underwater obstacles to maintain a static location while preparing for discharge of water bullets.

II. Underwater ROV Disruptor Methods (FIG. 4)

Figure 4:
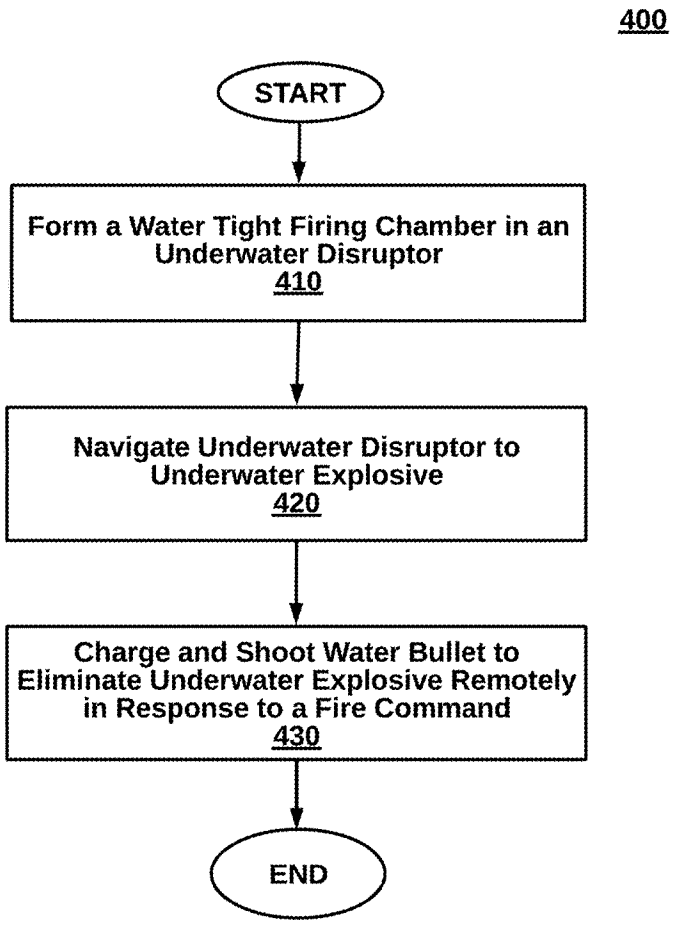
FIG. 4 is a high-level flow diagram illustrating a method for eliminating underwater explosives with an underwater ROV outfitted with a disruptor, according to some embodiments.

FIG. 4 is a high-level flow diagram illustrating a method 900 for eliminating underwater explosives an underwater ROV with a disruptor, according to an embodiment. The method 900 can be implemented in, for instance, system 100 of FIG. 1.

At step 410, a water tight firing chamber is formed in an underwater disruptor. At step 420, an underwater ROV navigates the underwater disruptor to a specific underwater explosive, guided by navigation sensors and identified using sonar and an HD camera. At step 430, the underwater disruptor charges and shoots the water bullet to potentially neutralize the specific underwater explosive, responsive to a fire command from the operator. In other embodiments, automatic processes determine when to fire the water bullet.

III. Additional Embodiments

Additional embodiments of the disclosure will be apparent to one of ordinary skill in the art. For example, the onboard controller 130 and the underwater ROV 110 of FIG. 1 are implemented in computing environments. The computing environments can include component such as a processor, a memory, a storage device and an I/O port.

The processor can be a network processor (e.g., optimized for IEEE 802.11), a general-purpose processor, an application-specific integrated circuit (ASIC), a field programmable gate array (FPGA), a reduced instruction set controller (RISC) processor, an integrated circuit, or the like. Qualcomm Atheros, Broadcom Corporation, and Marvell Semiconductors manufacture processors that are optimized for IEEE 802.11 devices. The processor can be single core, multiple core, or include more than one processing elements. The processor can be disposed on silicon or any other suitable material. The processor can receive and execute instructions and data stored in the memory or the storage drive.

The operating system can be one of the Microsoft Windows® family of operating systems (e.g., Windows 95, 98, Me, Windows NT, Windows 2000, Windows XP, Windows XP ×64 Edition, Windows Vista, Windows CE, Windows Mobile, Windows 8 or Windows 10), Linux, HP-UX, UNIX, Sun OS, Solaris, Mac OS X, Alpha OS, AIX, IRIX32, or IRIX64. Other operating systems may be used. Microsoft Windows is a trademark of Microsoft Corporation.

The memory further comprises network applications and an operating system. The network applications can include a web browser, a mobile application, an application that uses networking, a remote application executing locally, a network protocol application, a network management application, a network routing application, or the like.

The storage drive can be any non-volatile type of storage such as a magnetic disc, EEPROM, Flash, or the like. The storage drive stores code and data for applications.

The I/O port further comprises a user interface and a network interface. The user interface can output to a display device and receive input from, for example, a keyboard. The network interface (e.g. RF antennae) connects to a medium such as Ethernet or Wi-Fi for data input and output.

Many of the functionalities described herein can be implemented with computer software, computer hardware, or a combination.

Computer software products (e.g., non-transitory computer products storing source code) may be written in any of various suitable programming languages, such as C, C++, C #, Oracle® Java, JavaScript, PHP, Python, Perl, Ruby, AJAX, and Adobe® Flash®. The computer software product may be an independent application with data input and data display modules. Alternatively, the computer software products may be classes that are instantiated as distributed objects. The computer software products may also be component software such as Java Beans (from Sun Microsystems) or Enterprise Java Beans (EJB from Sun Microsystems).

Furthermore, the computer that is running the previously mentioned computer software may be connected to a network and may interface to other computers using this network. The network may be on an intranet or the Internet, among others. The network may be a wired network (e.g., using copper), telephone network, packet network, an optical network (e.g., using optical fiber), or a wireless network, or any combination of these. For example, data and other information may be passed between the computer and components (or steps) of a system of the invention using a wireless network using a protocol such as Wi-Fi (IEEE standards 802.11, 802.11a, 802.11b, 802.11e, 802.11g, 802.11i, 802.11n, and 802.11ac, just to name a few examples). For example, signals from a computer may be transferred, at least in part, wirelessly to components or other computers.

In an embodiment, with a Web browser executing on a computer workstation system, a user accesses a system on the World Wide Web (WWW) through a network such as the Internet. The Web browser is used to download web pages or other content in various formats including HTML, XML, text, PDF, and postscript, and may be used to upload information to other parts of the system. The Web browser may use uniform resource identifiers (URLs) to identify resources on the Web and hypertext transfer protocol (HTTP) in transferring files on the Web.

More generally, one of ordinary skill in the art will recognize that the examples set forth herein are non-limiting and only illustrative of widely-applicable principles. Accordingly, this description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

I claim:

1. An underwater ROV (remotely operated vehicle) system to disrupt remote underwater explosive threats, the underwater ROV system comprising:

an underwater disruptor comprising a water tight chamber formed by a modified housing, a modified breech, and a modified backplate each sealed together by a plurality of O-rings and each modified for water tightness, the underwater disruptor configured to discharge a firing pin to shoot a water bullet from a barrel at a specific underwater explosive threat responsive to receiving a fire command from a remote operator, wherein the water bullet is formed from water from the barrel due to the discharge; and an underwater ROV device physically hosting the underwater disruptor and configured to provide video feedback and location information during underwater travel remotely to the specific underwater explosive and to activate shooting of the water bullet responsive to the fire command, wherein a cable spans from the underwater ROV device to an onboard controller for providing data communications from the remote operator and for providing electrical power.

2. The underwater ROV system of claim 1, wherein the disruptor is an interchangeable accessory.

3. The underwater ROV system of claim 1, wherein the frame is further configured to host the underwater disruptor with a connection that interchangeably connects the underwater disrupter with at least one other peripheral.

4. The underwater ROV system of claim 1, wherein the underwater ROV device further comprises:

a waterproof electrical disruptor port configured to receive a connector for the disruptor; and an umbilical port-configured to receive a connector for the umbilical providing electrical power and data from an above-water onboard controller.

5. The underwater ROV system of claim 1, wherein the underwater ROV device further comprises:

a set of thrusters comprising at least three individual thrusters coupled to a rigid frame the underwater ROV device substantially along an x-axis, a y-axis, and a z-axis and individually controlled to position the underwater ROV device and to control and position the disruptor.

6. The underwater ROV system of claim 1, wherein the underwater ROV device further comprises:

a camera port to receive video.

7. The underwater ROV system of claim 1, wherein the underwater ROV device further comprises:

a navigation device port; and a gyroscope port.

8. The underwater ROV system of claim 1, further comprising:

a disruptor module configured to control the underwater disruptor from the underwater ROV device according to commands from the onboard controller.

9. A method in an underwater ROV (remotely operated vehicle) system to disrupt remote underwater explosive threats, implemented at least partially in hardware, the method comprising the steps of:

forming a water tight chamber in an underwater disruptor from a modified housing, a modified breech, and a modified backplate each sealed together by a plurality of O-rings;

physically attaching the underwater disruptor to an underwater ROV device;

remotely navigating the underwater ROV device to a specific underwater threat responsive to commands from a remote operator;

providing video feedback and location information from the underwater ROV device to the remote operator; and responsive to receiving a command from the remote operator, shooting a water bullet from a barrel of the underwater disruptor device at the specific underwater explosive threat, wherein a cable couples between the underwater ROV device and an onboard controller provides data communications to and from the remote operator and for providing electrical power.

* * * * *